US006863229B1

(12) United States Patent
Leisi

(10) Patent No.: US 6,863,229 B1
(45) Date of Patent: Mar. 8, 2005

(54) SPRAY HEAD

(76) Inventor: Marcel Leisi, Levratte 22, CH - 1260, Nyon (CH)

( * ) Notice: Subject to any disclaimer, the term of this patent is extended or adjusted under 35 U.S.C. 154(b) by 0 days.

(21) Appl. No.: 10/030,572

(22) PCT Filed: May 17, 2000

(86) PCT No.: PCT/CH00/00274

§ 371 (c)(1),
(2), (4) Date: Jan. 3, 2002

(87) PCT Pub. No.: WO01/03853

PCT Pub. Date: Jan. 18, 2001

(30) Foreign Application Priority Data

Jul. 7, 1999 (CH) ..... 1244/99

(51) Int. Cl.[7] ..... F23D 11/10

(52) U.S. Cl. ..... 239/418; 239/119; 239/394; 239/437; 239/451; 239/600

(58) Field of Search ..... 239/119, 418, 239/390, 391, 393, 394, 396, 436, 437, 451, 526, 600; 285/261

(56) References Cited

U.S. PATENT DOCUMENTS 3,116,882 A * 1/1964 Vork ..... 239/119
3,955,763 A * 5/1976 Pyle et al. ..... 239/119
4,516,724 A 5/1985 Hellman
5,765,753 A * 6/1998 Kieffer ..... 239/119

* cited by examiner

*Primary Examiner*—Dinh Q. Nguyen
(74) *Attorney, Agent, or Firm*—Ostrolenk, Faber, Gerb & Soffen, LLP

(57) ABSTRACT

Spray head 1 especially for a high-pressure spray gun, comprising a rotary element 3, which is placed in a central body 2 and through which passes a spray nozzle 37, and a seal 4 ensuring leak-tightness between the rotary element 3 and the gun, the rotary element 3 having a circular central part 31 comprising the nozzle 37 and introduced into a lateral aperture 21 of the central body 2, the circular central part 31 being brought, by means of an upward translational movement of the central body 2, into a working position against an inner abutment located at the top of the central body 2, the nozzle 37 placed in the circular part 31 of the rotary element 3 being in the working position above the top of the central body 2.

27 Claims, 5 Drawing Sheets

SPRAY HEAD

BACKGROUND OF THE INVENTION

The present invention concerns a spray head, especially for a high-pressure spray gun, comprising a rotary element, which is placed within a central body and through which passes a duct having a spray orifice, and a seal ensuring leak-tightness between the rotary element and the gun.

Patent Application PCT/CH97/00316 discloses a spray head for a high-pressure spray gun, comprising an element of a cylindrical shape, which is mounted rotatably in a central body and through which passes a main conduit. At the end of the conduit is mounted a spray nozzle for delivering a tapered high-pressure fluid jet. Two low-pressure air ducts are prolonged from the central body within the cylindrical-shaped element on either side of the central conduit of the nozzle. The air-jet outlet orifices in the element of cylindrical-shaped element are offset in relation to the inlet orifices in communication with the ducts of the central body.

Patent Application PCT/CH98/00104 discloses a spray head for a high-pressure spray gun, comprising a rotary element, which is placed in a central body and through which passes a duct having a spray orifice. A seal ensures leak-tightness between the rotary element and the gun. The rotary element has, in its central part, a spherical shape capable of cooperating with the seal placed within the central body. Two circular seats are placed on either said of the spherical part bearing on the seats placed on either side of the central body.

The disadvantage of the spray heads known in the prior art is that the slit of the nozzle is at a level substantially equal to or lower than the top of the spray head, which always results in interferences at the outlet of the fluid jet. Moreover, at the moment when work is stopped, the liquid which has been unable to leave the gun falls down around the nozzle. The user is therefore faced with the need to clean it in order to prevent dry paint from accumulating around the slit of the nozzle and on the top of the spray head. The problem becomes even more acute when spray heads with additional air jets are used, since the air jets cause turbulence giving rise to fluid sedimentation deposits on the top of the head. These deposits are particularly troublesome, since they give rise to droplets which may be thrown on to the articles to be treated by the air jets.

SUMMARY OF THE INVENTION

The object of the present invention is to overcome these disadvantages and to propose a spray head, especially for a high-pressure spray gun, comprising a rotary element, which is placed in a central body and through which passes a spray nozzle, and a seal ensuring leak-tightness between the rotary element and the gun. The invention is characterized in that the rotary element has a circular central part comprising the nozzle. The central part is introduced into a lateral aperture of the central body. Its circular central part is brought, by means of an upward translational movement of the central body, into a working position against at least one inner abutment located at the top of the central body. The nozzle, which is placed in the circular part of the rotary element, is in the working position above the top of the central body.

Due to the possibility of bringing the circular central part towards the top of the head by means of a translational movement, the nozzle placed on the central part can be raised and can emerge from the top of the head. This will limit the accumulation of paint on the appliance during use and also limit the residual deposits of the fluid which are liable to cause smearing of the articles to be sprayed or to be covered.

By means of the arrangement proposed according to the current invention, the nozzle can be induced to exceed the height of the top of the head by a distance of 1 to 5 mm.

According to a preferred embodiment, the central part of the rotary element has at least one lateral shoulder which takes the form of a spindle and cooperate with a groove-shaped prolongation of the lateral aperture of the central body. The central body has at least one inner abutment located in the lateral aperture. The groove of the central body makes it possible, after the rotary element is introduced into the central body, to displace the rotary element towards the top of the central body, until the shoulder comes to bear against the inner abutment of the top of the central body.

According to this same embodiment, the central part of the rotary element has a second shoulder of the central part, and the second shoulder is opposite the first and likewise takes the form of a spindle. The second shoulder cooperates with a groove made on the other side of the central body. The seal ensures leak-tightness between the central body and the gun slides in a bore made in the spindle and at the base of the central body, so as to come to bear against the circular central part of the rotary element.

Still according to this embodiment, the circular central part of the rotary element takes the form of a ball which cooperates with the seal within the central body.

In this case, the seal may advantageously have an indentation such that the ball-shaped central part of the rotary element rests on the two edges of the indentation.

In another embodiment, the circular central part of the rotary element takes the form of a cylinder which cooperates with the seal within the central body.

The central body advantageously has passing through it a series of ducts allowing a low-pressure air stream for setting the opening angle of the fluid taper emerging through the nozzle. The ducts are located on one said of the nozzle and on the other and forming at their outlet an acute angle to the central conduit of the nozzle.

The central body has two diametrically opposed stubs in its upper part. The central body has two complementary ducts passing through it which are prolonged within said stubs. The ducts have outlet orifices for directing a low-pressure air stream substantially perpendicularly to the slit of the nozzle, against the pressurized fluid taper emerging from the nozzle, thus causing the atomization of said the fluid taper.

The rotary element has a pin which butts against two rims in the central body so as to be positioned in two ways which correspond to the working configuration and the cleaning configuration of the nozzle. The rotary element is connected to a handle which makes it possible to rotate through 180° between the two respective working and cleaning positions. According to the preferred embodiment, the rotary element is made from steel, stainless steel or chrome steel which in all cases has undergone thermal treatment for hardening its surface. The nozzle is manufactured from hard metal, for example from tungsten carbide. The central body is made from anodized aluminum, from steel or from a synthetic material reinforced with carbon fiber, and the cylindrical seal is made from ferrous or non-ferrous metal or from reinforced composite material.

DESCRIPTION OF A PREFERRED EMBODIMENT

Figure 1:
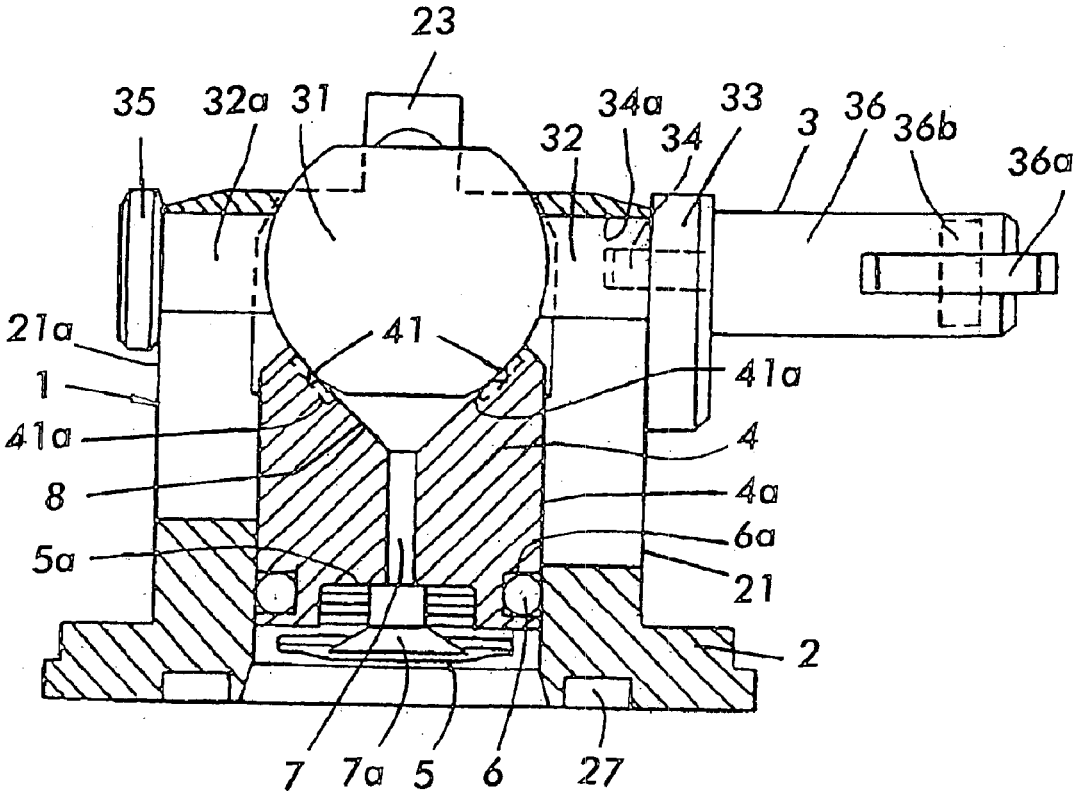
FIG. 1 shows a view of a spray head of one embodiment of the head, partially in section, together with all its component elements.

The spray head 1 illustrated in the drawing comprises a central body 2 through which a rotary element 3 passes. A cylindrical seal 4 is introduced into an axial bore 4*a* made in the central body, so as to be capable of sliding freely in said bore. The lower end of the seal 4 has a recess 5*a*, into which is positioned an end seal 5 which has a central aperture 7*a* issuing onto a central bore 7 made in the cylindrical seal 4. The seal 4 has at its base a circular outer groove 6*a*, in which is placed an O-ring seal 6 intended for ensuring leak-tightness between the cylindrical seal 4 and the bore 4*a* of the central body 2. The central bore 7 of the seal 4 widens in the form of a funnel 8 in its upper part, so as to come to bear against the rotary element 3, as explained below.

Figure 3:
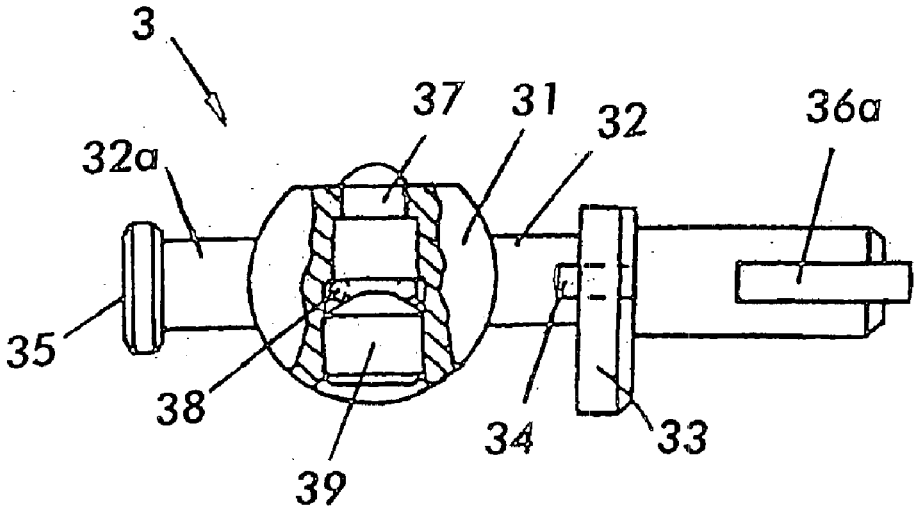
FIG. 3 shows a side view of the rotary element of FIG. 2, with a section through its central part.

The rotary element 3 comprises a central part 31 taking the form of a ball and two shoulders 32, 32*a*, taking the form of a spindle (see also FIG. 3). The shoulders 32 and 32*a* have at their free end a truncated disc 33 and a disc 35 respectively. The truncated disc 33 comprises a pin 34, cooperating with a recess 34*a* made in the central body 2 and the bottom of the recess serves as an abutment. A rod 36 extends outwards from the disc 33, prolongs the shoulder 32 along the same axis and receives at its free end a handle 36*a* fastened by means of a pin 36*b*. Alternatively, the handle 36*a* may be integrally molded from reinforced synthetic material.

The cylindrical seal 4 has on its inner surface a V-shaped indentation 41 in contact with the rotary element 3 which rests on the two edges of the indentation 41. This indentation may take the form, of a V or of a U. Alternatively, it may be replaced by a circular seal 41*a* which is preferably made from metal or from a composite material.

Figure 2:
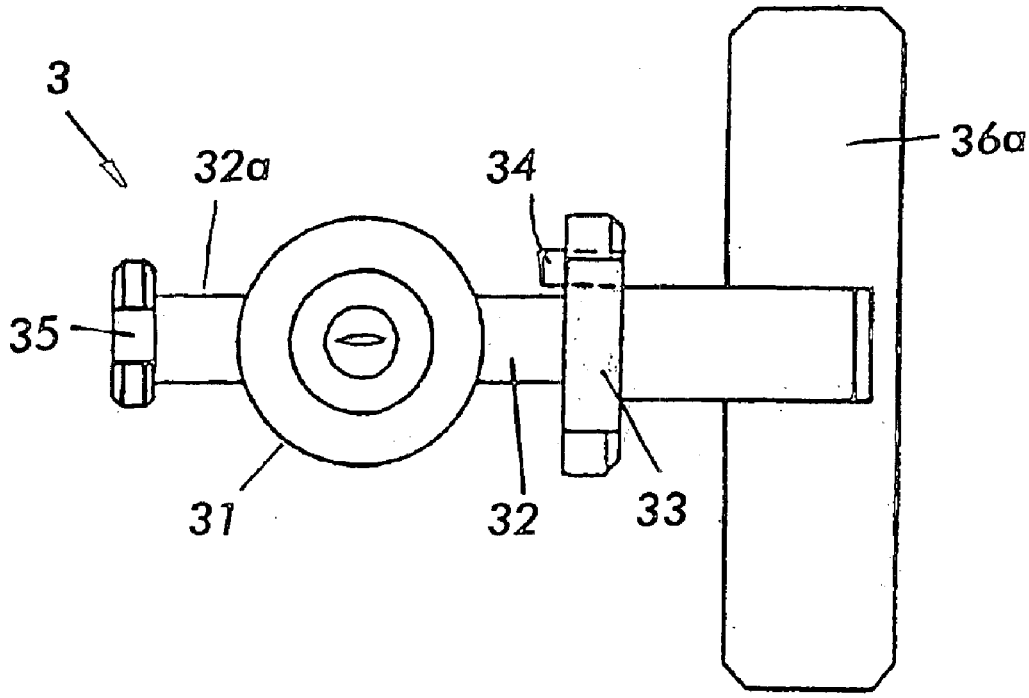
FIG. 2 shows a top view of a rotary element of the head.

Within the central part 31 (FIG. 3) of the rotary element 3 is located a tungsten carbide spray insert of nozzle 37 and a hollow screw 39 which grips the insert 37 by means of an O-ring seal 38 which is placed between the nozzle and the screw. The screw has a central bore, not shown, and is tightened with the aid of a hexagon-head spanner. The slit of the insert 37 is placed in the direction of the axis of the rotary element 3 (FIG. 2).

Figure 4:
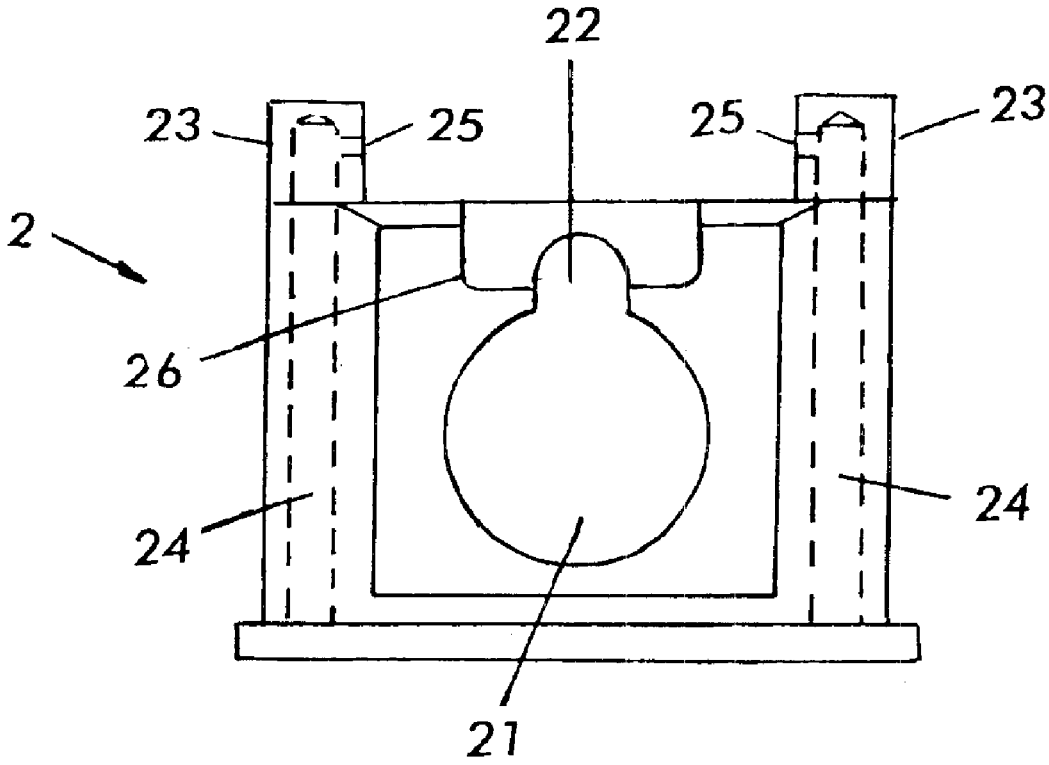
FIG. 4 shows a side view of the central body.
Figure 5:
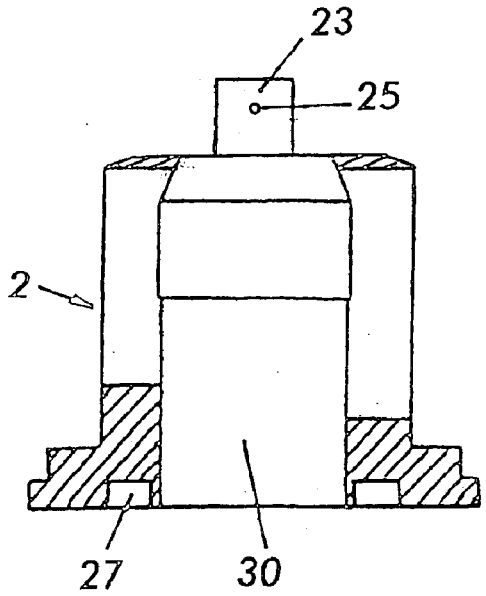
FIG. 5 shows a section through the central body of FIG. 1.
Figure 7:
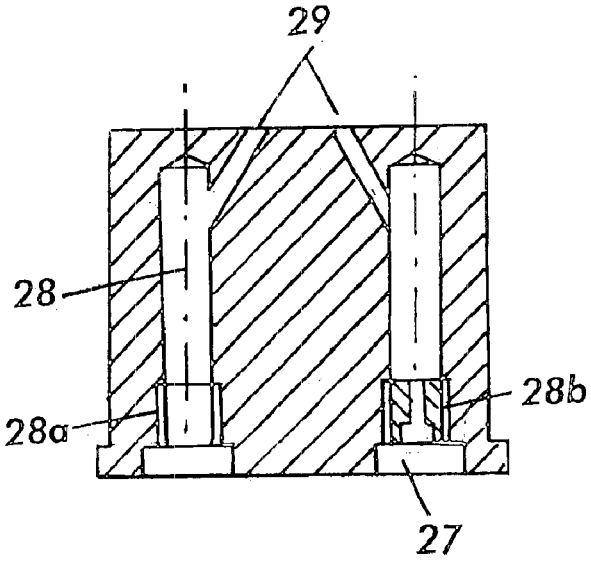
FIG. 7 shows a section through a detail of the central body along the line VII—VII of FIG. 6.
Figure 6:
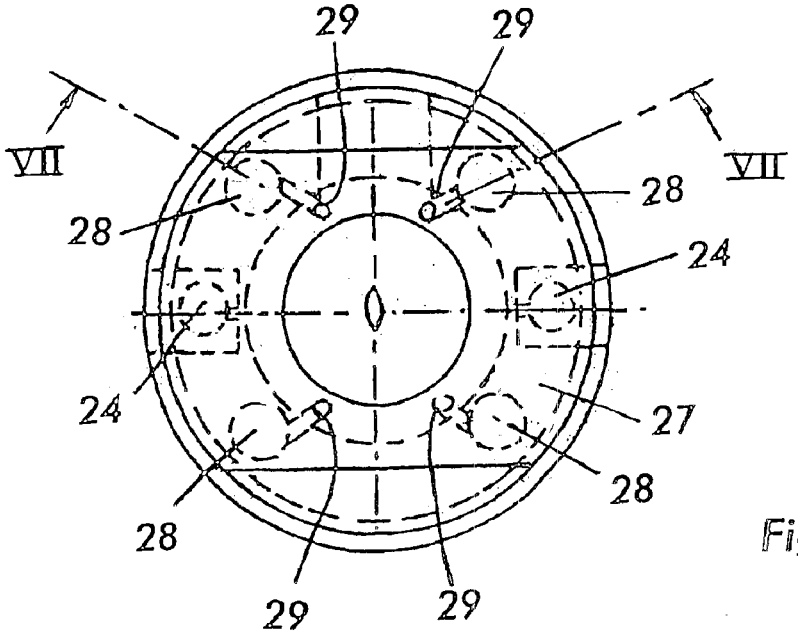
FIG. 6 shows a top view of the central body with a spray nozzle within it.

The central body 2 (FIGS. 4 and 5) has a first lateral aperture 21 which is prolonged upwards by a groove 22. A second lateral aperture 21*a* of smaller dimension is located on the opposite side to the first aperture and is likewise prolonged by a groove, like of the lateral aperture 21. Two stubs 23 are placed at the top of the central body. Each has an outlet orifice 25 in the direction of the axis of the central body and substantially perpendicular to the latter. These orifices 25 are in communication with two ducts 24 which pass through the wall of the central body in the direction of its axis and which are substantially perpendicular to the outlet orifices 25. These ducts 24 are intended for delivering an air stream towards the top of the spray insert 37 which is at the base of the jet. Their outlet orifices 25 may be replaced by slits. Further ducts 28 pass through the walls of the central body 2 in the direction of its axis so as to have access to the respective outlet orifices 29 (FIGS. 6 and 7) which are placed at the top of the central body and form an acute angle to the taper shape of the spray which emerges through the slit of the nozzle. These four orifices 29 are intended for delivering an air stream which makes it possible to change the spray angle. Within each of these ducts 28, and at its base, is provided a thread 28*a* which makes it possible to introduce, by means of a hexagon-head spanner, screws 28*b* which are used as air throttles. They take the form of hollow screws with different bore diameters for the purpose of varying the air flow. All the screws 28*b* of the same set have the same bore diameter. It is clear that the ducts 24 may likewise be provided with the hollow screws 28*b* serving for setting the air flow.

In the lower part the central body 2 has a groove in the form of a circular ring 27 cooperating for connection to the gun and allowing the low-pressure air to pass to the ducts 24, 28. In general, the guns used in conjunction with the spraying nozzle just described have one setting of compressed air which will be fed into the annular groove 27. The setting of the compressed air flow through the orifices 25 and 28 will be determined by the choice of the bores for the hollow screws 28*b*. There are on the market gun models with two different air settings. In this case, it will be possible to feed separately the ducts 24 and the orifices 25 issuing onto the stubs and the other ducts 28 and their respective orifices 29.

During operation, the rotary element 3 is introduced into the central body 2 through the aperture 21, and the truncated disc 33 having a diameter greater than the aperture 21 fixes the position up to which the rotary element 3 can be introduced. The disc 35 will emerge on the other side of the central body 2 through the aperture 21*a*. At this moment, the shoulders 32, 32*a* can slide over the entire height of the grooves 22 towards the top of the central body 2, until the shoulders 32 strike the upper part of the grooves 22. The rotary element 3 is then located at the top of the central body 2 and the spray nozzle 37 is above the top. The seal 4 slides within the bore 30 of the central body 2 so as to ensure leak-tightness between the latter and the gun which is not illustrated in the drawing. The indentation 41 of the cylindrical seal 4 ensures greater leak-tightness, since the central part 31 of the rotary element 3, which is ball-shaped in the drawing, rests on the two edges of the indentation 41. In order to ensure this leak-tightness more effectively, the cylindrical seal 4 has at its base the end seal 5 made from polyamide plastic (nylon), which connects the head 1 to the gun, and the O-ring seal 6 made from a material with the trademark Viton, which cooperates with the central body 2 within its bore 30.

When the spray head 1 is in its working position, as shown in FIG. 1, the high-pressure fluid arrives by way of the bores 7*a*, 7 and continues its path through the screw 39 and the nozzle 37 which are connected by means of the O-ring seal 38 made of Teflon. The fluid, which will emerge in the form of a taper shape of the spray through the spray nozzle 37, can be set by the addition of low-pressure air supplied by the two series of ducts (24, 28) which extend in the direction of the axis of the central body and within its walls. The pressurized air passes through the two ducts 24, coming from the groove 27 at the base of the central body 2, and arrives at the outlet orifices 25 which form a substantially right angle to the ducts. The low-pressure air is thrown substantially perpendicularly against the high-pressure fluid taper spray which emerges through the slit of the nozzle 37. This reinforces the atomization of the fluid taper spray by this supply of air. Low-pressure air likewise arrives at the ducts 28 which also extend from the base of the central body 2 and travels within the walls of the central body 2 in order to arrive at the orifices 29 which are inclined in relation to the ducts 28. The low-pressure air passes through the ducts 28 and emerges on one side of the nozzle 37 and on the other side, at the same time forming an acute angle to the central conduit of the nozzle 37. This makes it possible to set the opening angle of the fluid taper spray which emerges through the nozzle 37.

With the aid of the handle 35, the rotary element can rotate through 180°, and the nozzle 37 is then placed in such a way that its slit confronts the outlet of the bore 7 and is ready to be cleaned. This operation is very simple, since the pin 34 butts against the rims 26 of the recess 34*a* in the two opposite positions, in each case placing the rotary element 3 accurately.

The variant of the head illustrated in FIGS. 8 to 11 comprises a central body 2, through which a rotary element or key, not illustrated, passes. The rotary element is identical to the element 3 of the embodiment of FIGS. 1 to 7 and is provided with a seal, likewise not illustrated, which is identical to the seal 4 of FIGS. 1 to 7. In FIGS. 8 to 11, only the central body has been illustrated. The elements forming the central body and the elements forming the head 2 and participating in the operation of the latter are the same as those in the embodiment in FIGS. 1 to 7.

Figure 11:
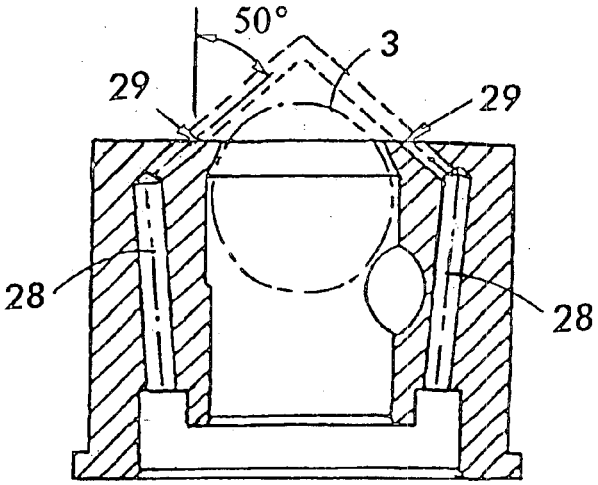
FIG. 11 is a sectional view along the line XI—XI of FIG. 8.

The head 2 of FIGS. 8 to 11 also has the lateral aperture 21 which is prolonged upwards by a groove 22 that allows the rotary element or key 3 to be introduced into the head 2 and brought into the working position by an upward translational movement in the groove 22, as illustrated in FIG. 11. The two stubs 23 placed at the top of the head 2 likewise have the outlet orifice 50 which, in this variation, is formed as a slit to direct the additional atomizing air at an angle of approximately 12° in relation to the axis of the head. This angle of 12° may, of course, vary within a range from 0 to 20°, if action is to be taken on the jet at the outlet of the nozzle or a little higher. This angle also depends on the height between the top of the nozzle and the top of the head, said height being in the range of 1 to 5 mm.

As shown in the embodiment of FIGS. 1 to 7, the atomizing orifices 50 are fed by the ducts 24 identical to those of the embodiment of FIGS. 1 to 7.

As shown in the embodiment of FIGS. 1 to 7, the ducts 28 (FIGS. 8 and 11) are connected to the outlet orifices 29 issuing at the top of the head 2. There are two outlet orifices, although there may be more, for example 4 or 6. As shown in the embodiment of FIGS. 1 to 7, these outlet orifices 29 are intended for the additional air opening of the sheaf of the main jet, to a greater or lesser degree. If there are 4 ducts, they will issue on either side of the axis XI—XI of the section of FIG. 11. If there are 6 ducts, they will be placed on either side of the ducts 28 of FIG. 8. As illustrated in FIG. 11, the outlet orifices 29 form an angle to the vertical axis of the head which varies within a range of 45 to 60°. In the variant of FIG. 11, the angle is 50°.

Figure 8:
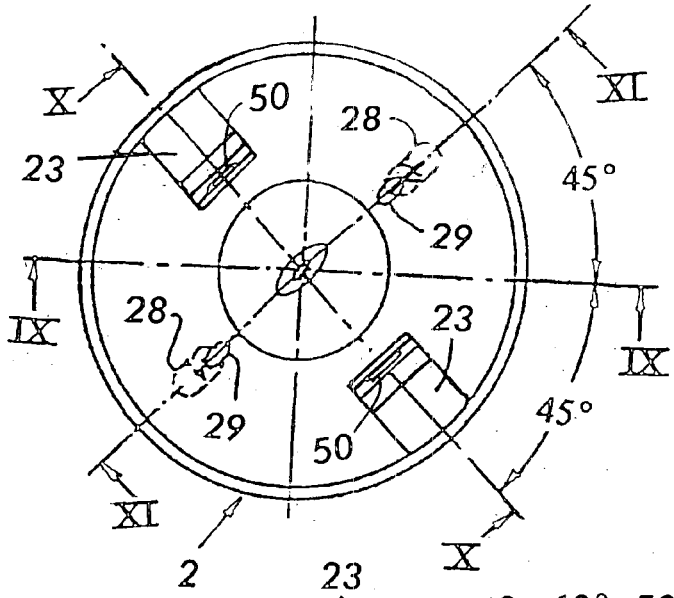
FIG. 8 is a top view of a variant of the head illustrated in FIGS. 1 to 7.
Figure 9:
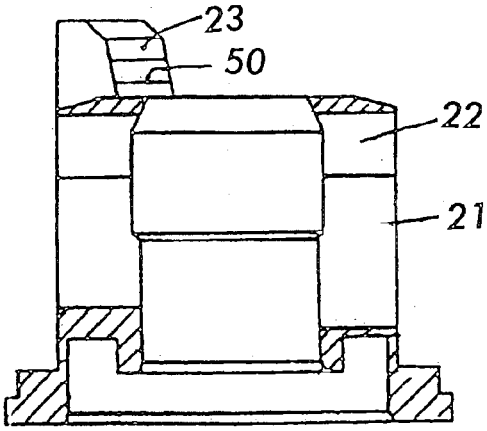
FIG. 9 is a sectional view along the line IX—IX of FIG. 8.
Figure 10:
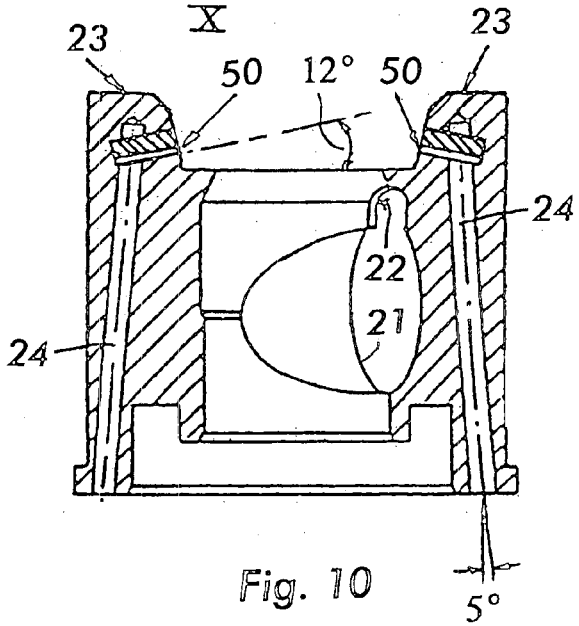
FIG. 10 is a sectional view along the line X—X of FIG. 8.

Finally, in the variation shown in FIGS. 8 to 11, the rotary element or key 3 is introduced into lateral apertures 21 of the head 2 which form an axis of 45° (axis IX—IX) of the section of FIG. 9) in relation to the two stubs 23 (line X—X of FIG. 8). Thus, the nozzle 51 (FIG. 8) is placed at 45° in relation to the axis of the rotary element or key 3. This arrangement is advantageous because it allows an improved distribution of the additional air ducts and consequently a simpler manufacture of the head.

The embodiment of FIGS. 1 to 7, and also the variant of FIGS. 8 to 11, comprises a rotary element formed as a ball and partially introduced into a funnel-shaped part located within the seal 4. As mentioned above, an indentation 41 is placed on the periphery of the funnel at the location where the spherical surface of the ball 31 is in contact with the interior of the seal. This indentation 41 may be produced by machining or moulding or by chasing the material of said seal. Alternatively, the indentation 41 may be replaced by a covering taking the form of a circular zone 41*a* inlaid within the cone, the zone 41*a* being in contact with the ball of the rotary element.

Although the embodiment and the variant which have just been described both have a rotary element or key 3 comprising a ball 31 placed between the two spindles 32 and 32*a*, it is clear that the invention is not limited to this solution and that the ball may be replaced by a cylinder or a concave circular surface. The seal 4 will then be matched to this surface by any means known to a person skilled in the art.

A central body 2 is produced from anodized aluminum; it may, however, be manufactured from stainless steel, from chrome steel or from plastic reinforced, for example, with carbon fibers.

The rotary element 3 and the seal 4 may likewise be produced from metal, from reinforced plastic or from ceramic.

What is claimed is:

1. A spray head for a spray gun, comprising:

a central body with a space therein; the central body having a lateral side and a lateral aperture passing through the lateral side; the central body having a top side, at least one inner abutment located in the lateral aperture at the top of the central body;

a rotary element which is placeable in the space of the central body by passing the rotary element through the lateral aperture of the central body;

a seal in the central body below the rotary element for sealing the rotary element leak-tight in the central body;

the rotary element having a circular shaped central part and the central part is introduced into the space in the central body, a nozzle with an exit from the central part of the rotary element;

the lateral aperture being shaped such that with the central part of the rotary element in the space in the central body, upward translational movement of the central part brings the central part into a working position against the inner abutment at the top side of the central body, the central part of the rotary element being so shaped and the nozzle being so placed on the central part of the rotary element that the nozzle has a working position with the central part of the rotary element abutting the inner abutment of the central body and that the nozzle in the working position is above the top side of the central body.

2. The spray head of claim 1, further comprising a first lateral shoulder from the central part of the rotary element which cooperates with the inner abutment of the central body as the rotary element is moved toward the top of the central body.

3. The spray head of claim 2, wherein the first lateral shoulder of the rotary element comprises a spindle projecting from the central part;

the lateral aperture in the central body includes a groove shaped prolongation extending toward the top of the central body such that after the rotary element is introduced into the space of the central body, the spindle of the rotary element is displaceable up through the groove shaped prolongation of the lateral aperture toward the top side of the central body until the first shoulder on the spindle bears against the inner abutment at the top of the central body.

4. The spray head of claim 3, further comprising a second lateral shoulder of the central part opposite the first shoulder thereof, the second shoulder comprising a second spindle;

a second lateral aperture in the opposite side of the central body from the lateral aperture and the second spindle being received in the second lateral aperture.

5. The spray head of claim 1, wherein the central body has a bore leading to the space which receives the rotary element; and a seal for leak tightness being received in the bore of the central body and bearing against the central part of the rotary element.

6. The spray head of claim 5, wherein the circular central part of the rotary element has the shape of a ball that cooperates with the seal.

7. The spray head of claim 6, wherein the seal includes an indentation facing toward and cooperating with the ball shaped central part of the rotary element and the indentation has edges along which the central part of the rotary element rests.

8. The spray head of claim 7, wherein the seal in the central body is comprised of stainless steel or a reinforced composite material.

9. The spray head of claim 5, wherein the circular central part of the rotary element has the form of a cylinder which engages the seal in the central body.

10. The spray head of claim 1, further comprising the nozzle having an outlet slit; a plurality of ducts passing through the central body for passing air flow, the ducts being located on either side of the nozzle and being directed toward the slit of the nozzle for allowing an air stream for setting the opening angle of the fluid emerging through the nozzle slit.

11. The spray head of claim 10, wherein the ducts have respective outlet orifices oriented to direct additional air at an angle of 45° to 60° in relation to an axis of the spray head through the nozzle for directing additional air to close and open the angle of the fluid taper through the nozzle.

12. The spray head of claim 1, further comprising two diametrically opposed stubs toward the top side of the central body;

two complementary ducts in the central body prolonged within the stubs, each of the ducts and the stubs having a respective outlet orifice for directing an air stream substantially perpendicularly to the slit of the nozzle and against a pressurized fluid taper emerging from the nozzle wherein the air stream is adapted for causing atomization of the fluid taper.

13. The spray head of claim 12, further comprising each of the ducts having a base, a threaded opening at the base of each duct for receiving a hollow screw with a bore diameter therethrough selected for controlling air flow therethrough.

14. The spray head of claim 12, further comprising a plurality of the ducts passing through the central body for air flow, the ducts being located on either side of the nozzle and being directed toward the outlet slit of the nozzle for allowing an air stream for setting the opening angle of the fluid emerging through the nozzle slit.

15. The spray head of claim 1, further comprising a handle connected to the rotary clement for rotating the rotary element between the working position with the nozzle outlet directed out of the top of the central body and a cleaning position where the nozzle is exposed in the central body for cleaning.

16. The spray head of claim 12, wherein the outlet orifices of the two stubs are oriented to direct additional atomizing air at an angle of 0° to 20° in relation to the axis of the spray head through the nozzle.

17. The spray head of claim 12, wherein the lateral aperture is so placed that the rotary element is introduced into the head along an axis perpendicular to the line connecting the stubs which are at the top side of the central body and the nozzle including an outlet a slit that is perpendicular to the line.

18. The rotary element of claim 12, wherein the lateral aperture is so placed that the rotary element is introduced to the head along an axis of 45° in relation to the line connecting the stubs at the top side of the central body, and the nozzle includes a slit outlet which forms an angle perpendicular to the line.

19. The spray head of claim 1, further comprising two separated rims in the central body; the rotary element including an abutting element which abuts one or the other of the rims, the rims being so placed in the central body that with the abutment abutting one or the other rim, the rotary element is positioned selectively in a working position at which the nozzle outlets out of the top side of the central body and a cleaning configuration at which the nozzle is positioned to be cleaned.

20. The spray head of claim 1, wherein the rotary element is made from steel, stainless steel or chrome steel.

21. The spray head of claim 1, wherein the nozzle in the rotary element is made from a hard metal.

22. The spray head of claim 21, wherein the nozzle in the rotary element is made from tungsten carbide.

23. The spray head of claim 1, wherein the rotary element includes an O-ring seal connecting the outlet nozzle located in the rotary element to a clamping screw located in the rotary element.

24. The spray head of claim 1, wherein the central body is comprised of anodized aluminum, steel or a synthetic material reinforced with carbon fiber.

25. The spray head of claim 1, further comprising a further seal connecting the seal which passes through the central body to a spray gun to which the spray head is connected.

26. The spray head of claim 25, further comprising an O-ring in the seal in the central body for leak tightness of the seal with respect to the central body.

27. The spray head of claim 1, wherein the lateral aperture is so shaped, the rotary element is so shaped, and the nozzle is so placed on the rotary element that when the nozzle is positioned with the circular central part in the working position, the nozzle is located at a distance of 1 mm to 5 mm above the top of the central body.

* * * * *